US006053578A

United States Patent [19]

van Hekken et al.

[11] Patent Number: 6,053,578

[45] Date of Patent: *Apr. 25, 2000

[54] MULTI-ADJUSTABLE ARMREST ASSEMBLY

[75] Inventors: Hendrik R. van Hekken, Allentown, Pa.; Cira V. Conley, Chicago; Michael S. Garner, Northbrook, both of Ill.

[73] Assignee: Knoll, Inc., East Greenville, Pa.

[ * ] Notice: This patent is subject to a terminal disclaimer.

[21] Appl. No.: 09/404,740

[22] Filed: Sep. 24, 1999

Related U.S. Application Data

[63] Continuation of application No. 08/868,678, Jun. 4, 1997.

[51] Int. Cl.[7] ..... A47C 7/54

[52] U.S. Cl. ..... 297/411.35; 797/411.36; 797/411.37; 797/411.38

[58] Field of Search ..... 297/411.35, 411.37, 297/115, 411.38, 411.36; 248/118

[56] References Cited

U.S. PATENT DOCUMENTS

| | | |
|---|---|---|
| 3,950,027 | 4/1976 | Wilson . |
| 4,456,298 | 6/1984 | Gottstein . |
| 4,951,995 | 8/1990 | Teppo et al. . |
| 4,961,610 | 10/1990 | Reeder et al. . |
| 5,050,933 | 9/1991 | Tornero et al. . |
| 5,056,863 | 10/1991 | DeKraker et al. . |
| 5,143,422 | 9/1992 | Althofer et al. . |
| 5,265,938 | 11/1993 | Melhuish et al. . |
| 5,324,096 | 6/1994 | Schultz . |
| 5,338,133 | 8/1994 | Tornero . |
| 5,346,284 | 9/1994 | Dauphin . |
| 5,382,079 | 1/1995 | Wilson et al. . |
| 5,393,124 | 2/1995 | Neil . |
| 5,393,125 | 2/1995 | Watson et al. . |
| 5,439,267 | 8/1995 | Peterson et al. . |
| 5,462,338 | 10/1995 | Baumann . |
| 5,484,187 | 1/1996 | Doerner et al. . |
| 5,655,814 | 8/1997 | Gibbs . |
| 5,660,442 | 8/1997 | Tornero . |
| 5,746,480 | 5/1998 | Bonutti . |
| 5,752,683 | 5/1998 | Novis et al. . |

*Primary Examiner*—Anthony D. Barfield
*Attorney, Agent, or Firm*—Buchanan Ingersoll, P.C.

[57] ABSTRACT

A multi-adjustable armrest assembly for a chair can be adjusted in a variety of different aspects including laterally, vertically, forwards and backwards, and rotationally. Such an armrest assembly can include an armrest base securable to a chair and having a tubular portion, an armrest support having a vertical leg and a horizontal leg slidably disposed in the tubular portion, a shroud slidably disposed on the vertical leg, a post member attached to the shroud, a collar connected to the post, and an armrest connected to the collar. Additionally, the armrest can have a bottom portion slidably connected to the collar and the collar can be rotatably connected to the post. Furthermore, a positive adjustment mechanism can be provided to control each adjustable aspect of such an armrest assembly.

2 Claims, 14 Drawing Sheets

MULTI-ADJUSTABLE ARMREST ASSEMBLY

This application is a continuation application of U.S. patent application Ser. No.08/868,678, filed Jun. 4, 1997, which is hereby incorporated herein by reference.

BACKGROUND OF THE INVENTION

The present invention relates generally to armrests for chairs and more particularly, to an armrest assembly which is adjustable in a variety of aspects.

A wide variety of adjustable office chairs are presently available. In an attempt to adapt the chair to a particular user or task, various adjustment mechanisms have been provided. Such chairs may, for example, include vertically adjustable seat height mechanisms, swivel tilt mechanisms, and adjustable back height mechanisms. Additionally, such chairs may be provided with adjustable armrest assemblies. Many such chairs have been provided which have an adjustable height armrest, such as U.S. Pat. No. 5,393,125 to Watson et al. Other such chairs have armrests which can be adjustable laterally to effect the spacing between the armrests, or armrests which can be rotated in towards the user or out away from the user. In most instances, such armrests are only adjustable in one of the particular aspects described above. However, U.S. Pat. No. 5,439,267 to Peterson et al provides an adjustable armrest assembly wherein the armrest can be adjusted vertically and an arm pad portion of the armrest can be moved laterally. However, no known contemporary armrest assemblies can provide for all of the different aspects of movements described above in a single armrest assembly.

Therefore, a need exists for a multi-adjustable armrest assembly which provides for vertical height adjustment, lateral positioning, rotational positioning, and forwards and backwards positioning of the arm pad portion of the armrest assembly. Such a multi-adjustable armrest which provides positive adjustment in each of the aspects described can provide the widest possible variety of adjustable positions to accommodate users of different proportions and different tasks.

SUMMARY OF THE INVENTION

The present invention is directed to a multi-adjustable armrest assembly securable to a chair which can be adjusted in a wide variety of aspects for conveniently adapting to users of different proportions and also to comfortably accommodate various tasks performed while seated in the chair.

An armrest assembly having features of the present invention can include a base securable to a chair and having a tubular portion, an armrest support having a vertical leg and a horizontal leg slidably disposed in the tubular portion, a shroud slidably disposed on the vertical leg, a post member attached to the shroud, a collar connected to the post, and an armrest connected to the collar. Additionally, the armrest can have a bottom portion slidably connected to the collar and the collar can be rotatably connected to the post.

In the usual case, two such multi-adjustable arm assemblies will be provided with one assembly secured at either side of a chair. Preferably, such a multi-adjustable armrest assembly can be adjustable in four different aspects.

First, the horizontal leg can adjustably slide within the tubular portion of the base. This adjustment permits the armrest to be moved laterally in toward or out away from the chair. Thus, the spacing between the two armrest assemblies at either side of the chair can be varied from a wide position to a narrow one according to the size of the person seated in the chair. Moreover, each armrest assembly can be adjusted independently of the other.

Second, the shroud can be slidably disposed over the vertical leg of the armrest support so that the armrest can be moved up and down along the vertical leg. This adjustment permits the height of the each armrest to be varied according to the preference of the person seated in the chair.

Third, the bottom portion of the armrest can slide with respect to the collar. This adjustment allows the armrest to be moved forwards and backwards relative to the armrest support so that the person seated in the chair can adjust the arm pad back and forth to find the most comfortable position.

Lastly, the post member can be rotatably connected to the collar. This adjustment allows the armrest to be rotated about the vertical leg of the armrest support. Thus, the armrest can be rotated inwardly, towards the person seated in the chair, or outwardly, away from the person, and secured in a position which is most comfortable for the user.

A positive adjustment mechanism can preferably be provided to control each adjustable aspect described above. Each positive adjustment mechanism can both lock the armrest in the desired position and release the armrest to permit it to be moved to a more comfortable position.

Other details, objects, and advantages of the invention will become apparent from the following description and the accompanying drawings of certain presently preferred embodiments thereof.

BRIEF DESCRIPTION OF THE DRAWINGS

In the accompanying figures, certain preferred embodiments of the invention are illustrated in which.

DETAILED DESCRIPTION OF THE PREFERRED EMBODIMENTS

Figure 1:
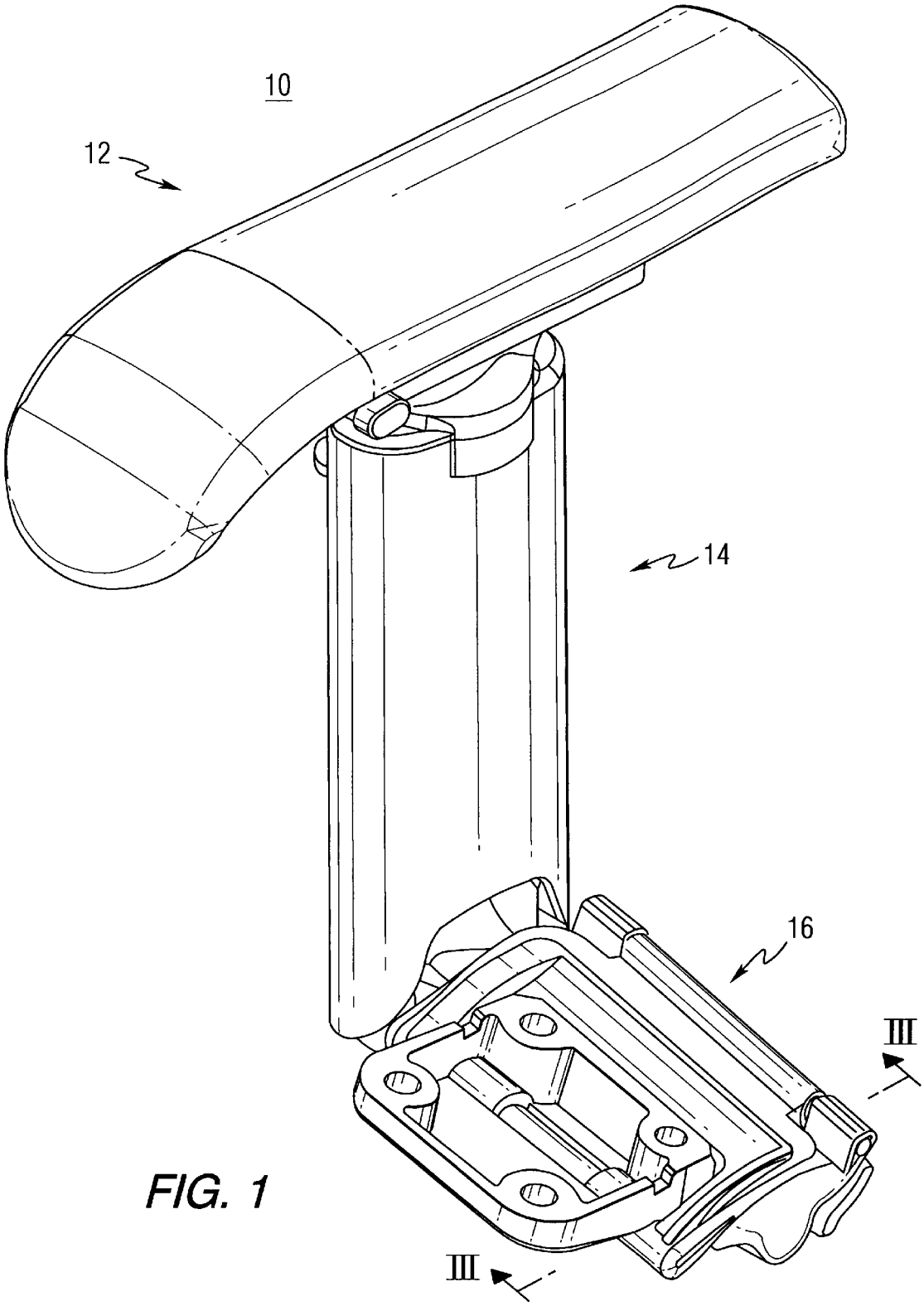
FIG. 1 is a perspective view of an embodiment of the invention.

Referring now to the drawing figures wherein like reference numbers refer to similar parts throughout the several views, a multi-adjustable armrest assembly is best illustrated in FIGS. 1, 2, 5, and 12.

A multi-adjustable armrest assembly 10 can include an armrest base 16 securable to a chair, an armrest support 14 having a vertical leg 20 and a horizontal leg 22 slidably connected to the armrest base 16, a shroud 44 slidably disposed on the vertical leg 20, a post 50 attached to the shroud 44, a collar 80 connected to the post 50, and an armrest 12 connected to the collar 80. Additionally, the armrest 12 can include a bottom portion 110 slidably connected to the collar 80. Furthermore, the collar 80 can be rotatably connected to the post 50.

Figure 2:
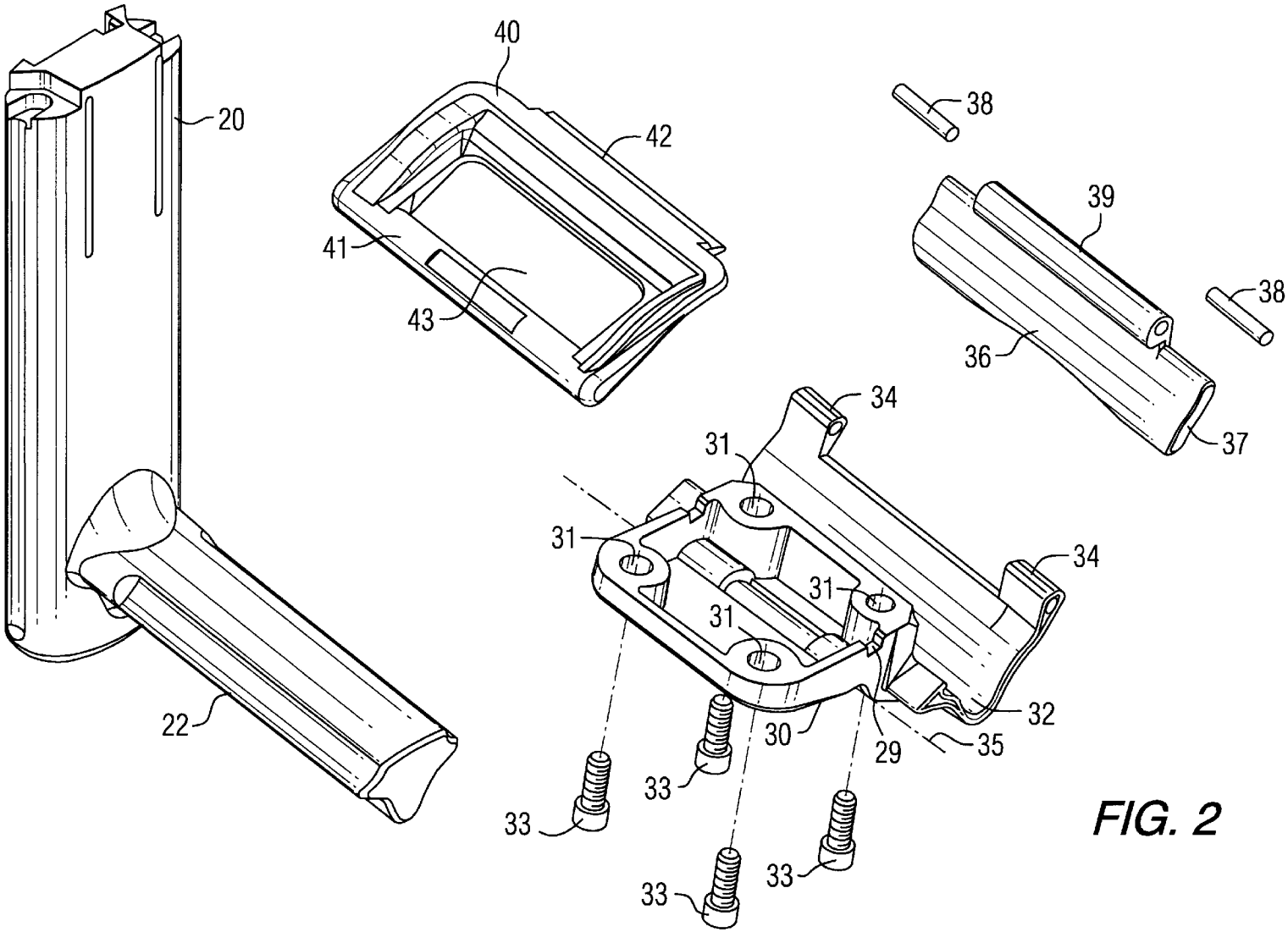
FIG. 2 is an exploded view of the lower portion of the embodiment shown in FIG. 1.

Beginning with FIG. 2, the armrest base 16 can include a mounting portion 30 which is attachable to the base of a chair by fasteners 33, which can be screws, and a tubular portion defined by an upwardly opening channel 32, a cover 40, and a clamping member 36. The channel 32, clamping member 36, and cover 40 cooperate together to form a first positive adjustment mechanism to laterally adjust the armrest assembly 10 into and away from the chair in an infinite number of positions. The cover 40 can have a generally cylindrical member 41 which is disposed in an arcuate shaped slot 29 in the underside of the mounting portion 30. The cover 40 pivots about the axis, denoted by numeral 35, of the cylindrical member 41 in the slot 29 to cover the channel 32 thus enclosing the horizontal leg 22 therein. Additionally, a stop means (not shown) can be provided to prevent the horizontal leg 22 from being completely removed from the channel 32.

Figure 3:
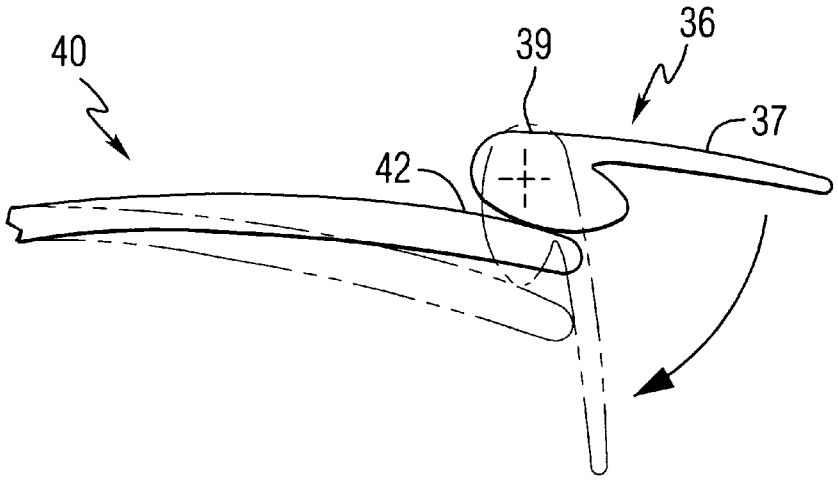
FIG. 3 is a partial cross section view taken along the line III—III.

The cover 40 extends over the channel 32, with the mounting portion 30 extending through the opening 43, and has an edge 42 which cooperates with the clamping member 36. A cam portion 39 of the clamping member 36 is rotatably connected at a hinge 34 by pins 38 and is pivotable between a clamped position and an unclamped position. The cam portion 39 can have the cross-section shown in FIG. 3. The horizontal leg 22 is slidably positioned in the channel 32 when the clamping member 36 is in the unclamped position. In the clamped position, the cam portion 39 engages the edge 42 of the cover 40 and forces the cover 40 down against the horizontal leg 22 such that it can no longer slide in the channel 32. The clamped position of the clamp member 36 and the cover 40 is shown in phantom lines in FIG. 3.

Figure 4:
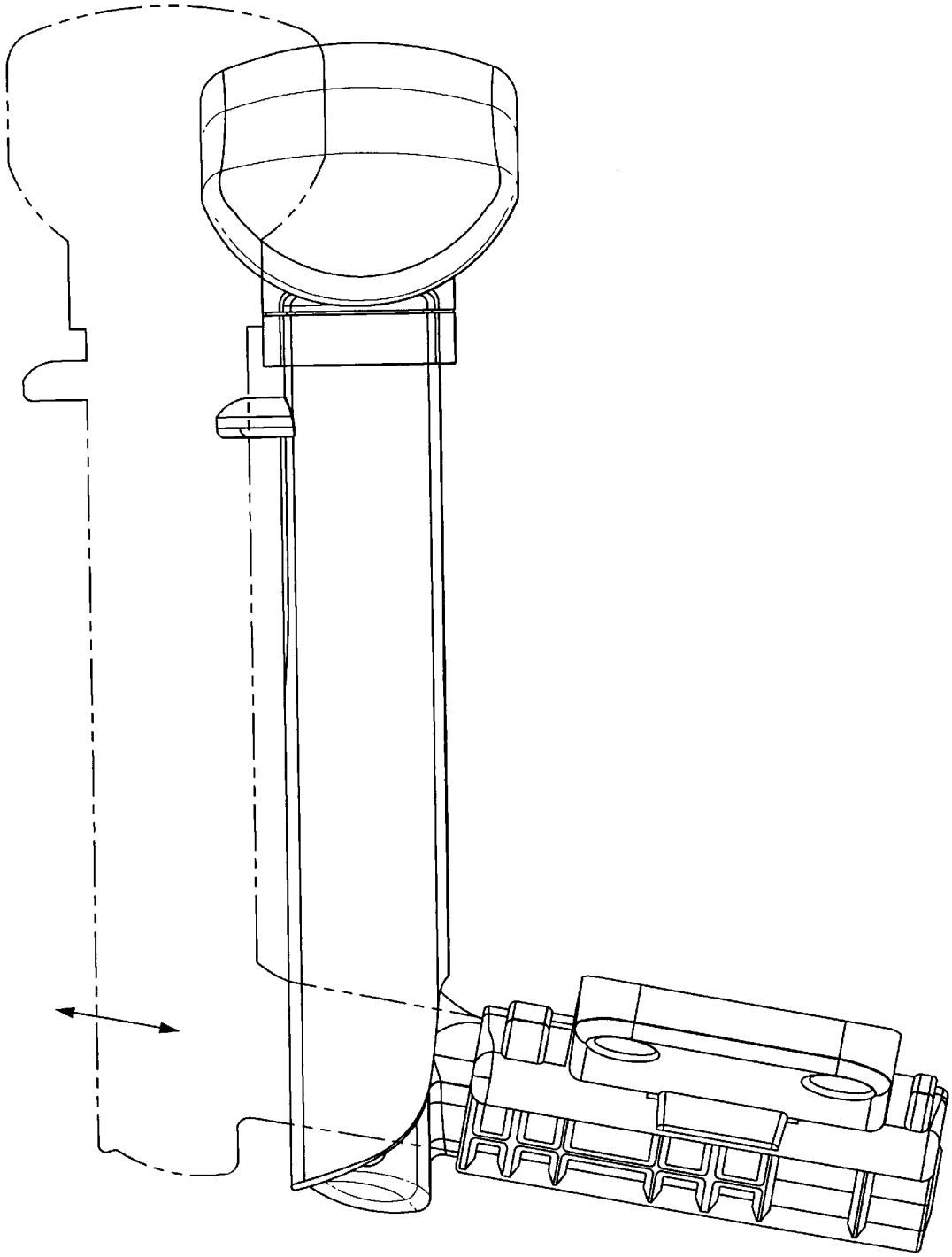
FIG. 4 illustrates how the armrest assembly shown in FIG. 1 can move laterally.

In order to laterally adjust the armrest 10, a user grasps the handle portion 37 and pulls upwardly. As the handle portion is pulled upwards, the cam portion 39 pivots about the hinge 34 and releases the edge 42 into the unclamped position, thus releasing the cover 40 from its frictional engagement with the horizontal leg 22 so that it can slide freely in channel 32, into or away from the chair, as shown in FIG. 4. Once the user locates the desired lateral position of the armrest 10, the user simply swings the clamping member 36 downwardly into the clamped position. As the handle portion 37 is pushed downwards, the cam portion 39 pivots about the hinge 34 and urges the edge 42 of the cover 40 downwards such that the cover 42 is pressed against the horizontal leg 22 so that it can no longer slide in the channel 32.

Figure 5:
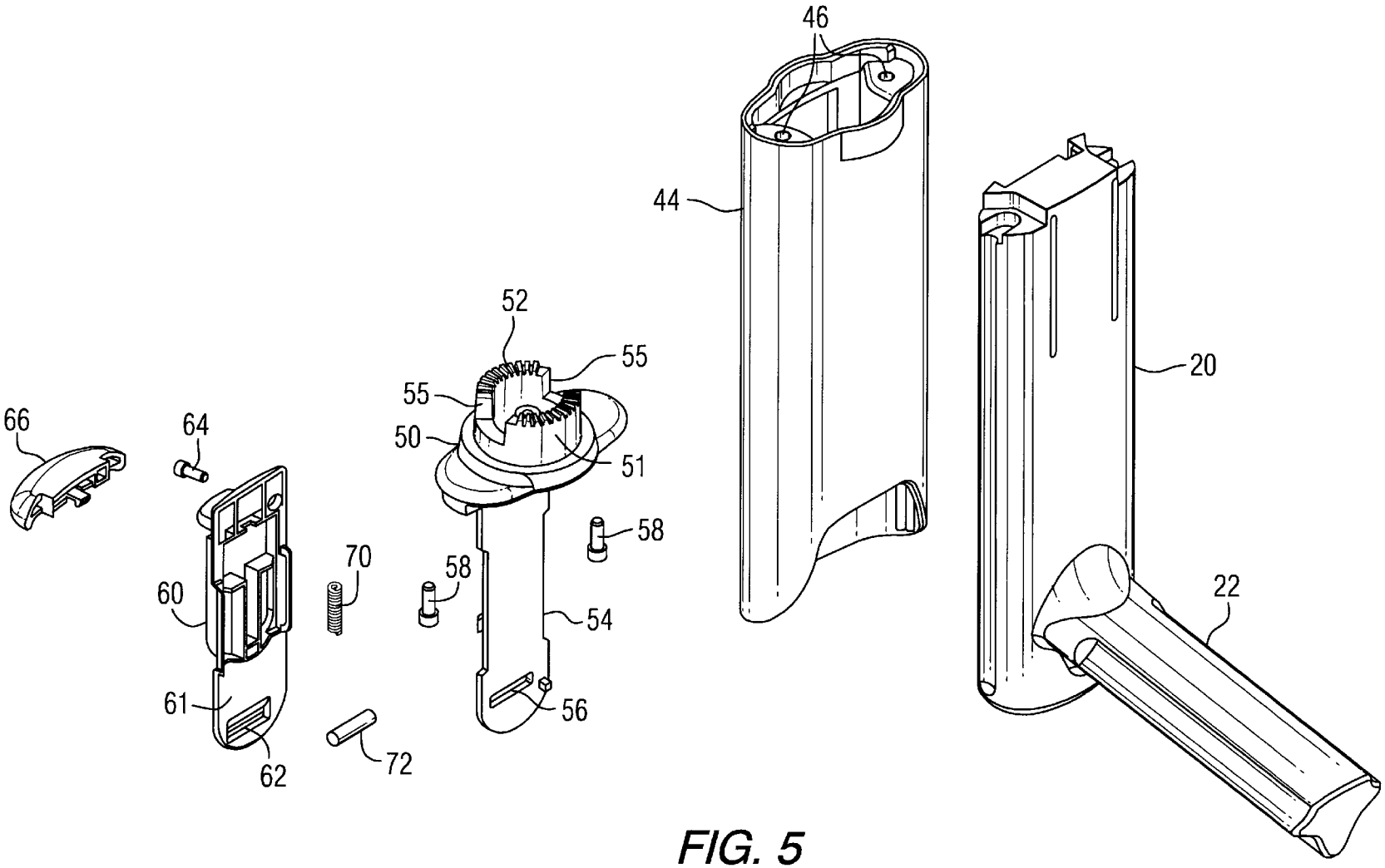
FIG. 5 is an exploded view of the middle portion of the embodiment shown in FIG. 1.

Referring next to FIG. 5, a shroud 44 can be slidably disposed over the top of the vertical leg 20 of the armrest support 14. A post 50 can be provided having a top end 51 and a lower end 54. The lower end 54 is housed within the shroud 44 adjacent the vertical leg 20. The top end 51 is attached to the top of the shroud 44 through holes 46 using fasteners 58.

Figure 6:
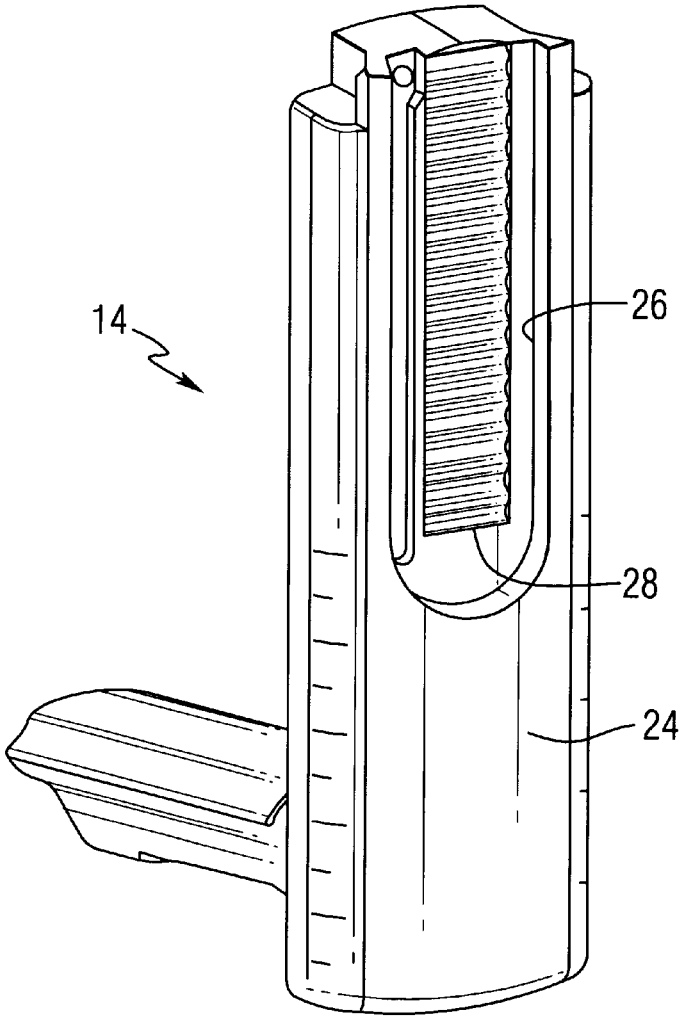
FIG. 6 is a perspective view of the opposite side of an embodiment of an armrest support shown in FIG. 2.
Figure 8:
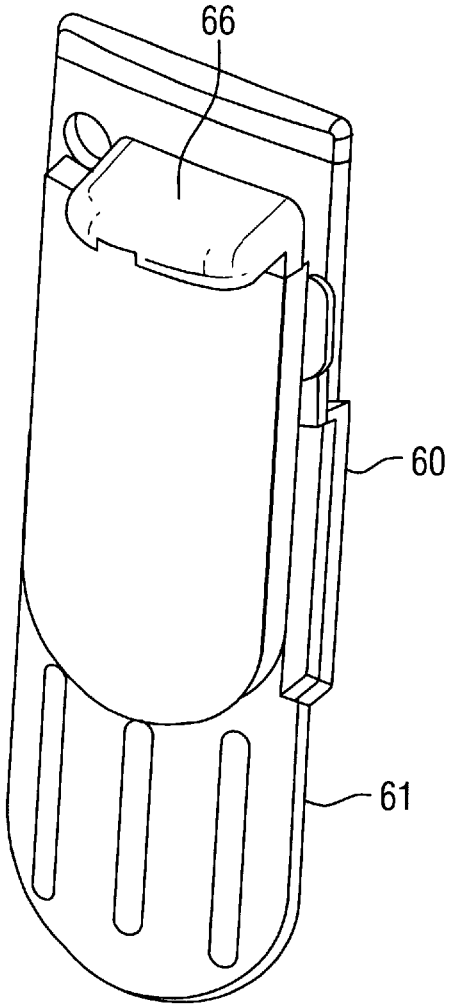
FIG. 8 is a perspective view of an embodiment of an actuator.

A second positive adjustment mechanism for vertically adjusting the height of the armrest 12 can be formed from cooperating portions of a slide member 60, the lower end 54 of the post 50, and an outer surface 24 of the vertical leg 20 which is provided with a plurality of grooves 28 as shown in FIG. 6. The lower end 54 of the post 50 can be positioned adjacent to the plurality of grooves 28 and can have a slot 56 provided therethrough. The slide member 60, shown best in FIGS. 8 and 9, can include a lower lock plate portion 61 which has a pocket 62 provided therein positioned adjacent to the slot 56. A cylindrical pin 72 can be provided in the slot 56 in communication with the pocket 62 on one side and the plurality of grooves 28 on the opposite side.

Figure 11:
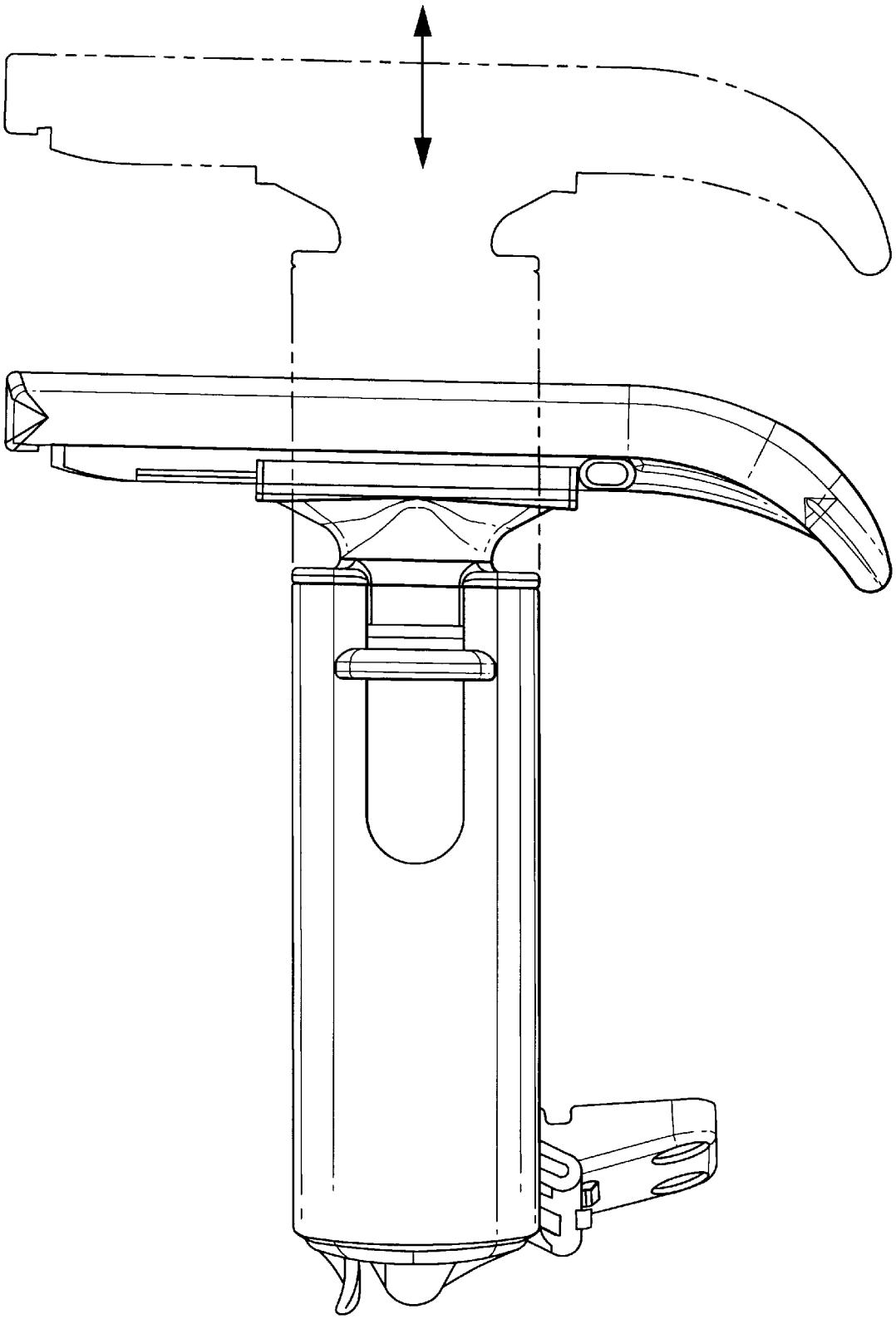
FIG. 11 illustrates how the armrest assembly shown in FIG. 1 can move vertically.

The lock plate 61 can move between an unlocked position and a locked position. In the locked position, the cylindrical pin 72 is retained by the lock plate 61 in one of the plurality of grooves 28 such that the shroud 44 is locked in place. In the unlocked position the cylindrical pin 72 is released into the pocket 62 of the lock plate 61 out of engagement with one of the plurality of grooves 28 so that the shroud 44 can slide upwardly and downwardly along the vertical leg 20, as shown in FIG. 11.

Figure 10:
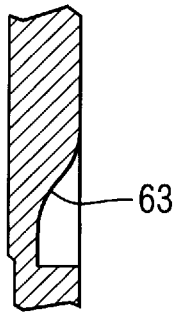
FIG. 10 is a partial cross section taken along the line X—X.

The pocket 62 can have a ramped profile 63, as shown in FIG. 10. The ramped profile 63 rolls the cylindrical pin 72 into one of the plurality of grooves 28 whenever the lock plate 61 is moved to a locked position. When the lock plate 61 is moved to an unlocked position, the cylindrical pin 72 is released into the pocket 62 and out of engagement with one of the plurality of grooves 28.

Figure 9:
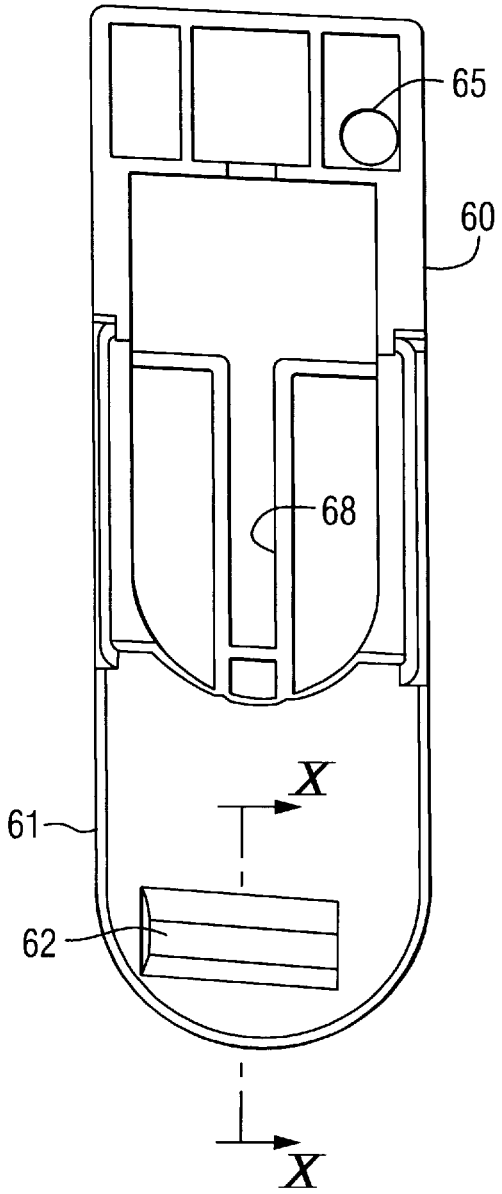
FIG. 9 is a rear plan view of the actuator shown in FIG. 8.

As shown in FIG. 5, a spring 70 can be disposed in a channel 68, which can be seen best in FIG. 9, provided in the slide member 60 such that the spring 70 biases the lock plate 61 into a locked position. Additionally, an externally accessible actuator 66, shown in FIGS. 5 and 8, can be provided connected to the slide member 60 and cooperating with the lock plate 61 such that a person may pull upwards on the actuator 66 to unlock the lock plate 61 to adjust the height of the armrest 12 along the vertical leg 20. When the actuator 66 is released the spring 70 can urge the lock plate back into a locked position.

Figure 7:
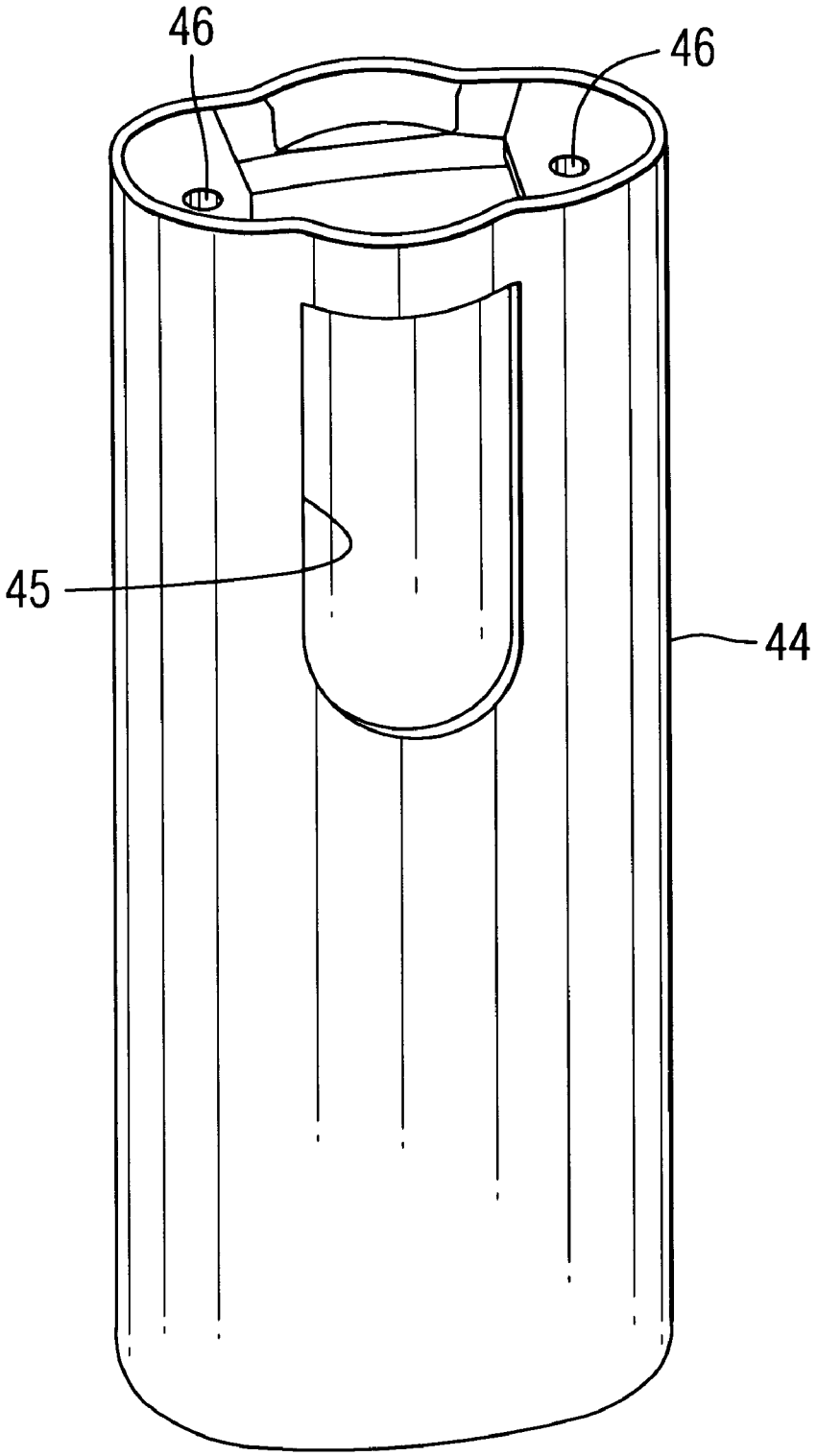
FIG. 7 is a perspective view of the opposite side of an embodiment of a shroud shown in FIG. 5.

An outer surface of the shroud 44 can be provided with an opening 45, as shown in FIG. 7, so that the slide member 60 (which is housed within the shroud 44) and the actuator 66 can be accessible to the user. Additionally, the outer surface 24 of the vertical leg 20 can be provided with a recessed portion 26, shown in FIG. 6, wherein the lower end 54 of the post 50 and the slide member 60 can be disposed inside the shroud 44 and adjacent to the plurality of grooves 28. Furthermore, a stop member 64 can be provided for preventing shroud 44 from being completely disengaged from the vertical leg 20. The stop member 64, which can comprise a screw or fastener, passes through slide member 60, post 50 and is engaged with vertical leg 20. Shroud 44 can include a matching stop catch (not shown) to mate with stop member 64 so as to prevent removal of the shroud 44 and the remainder of the armrest assembly from the vertical leg 20.

Figure 12:
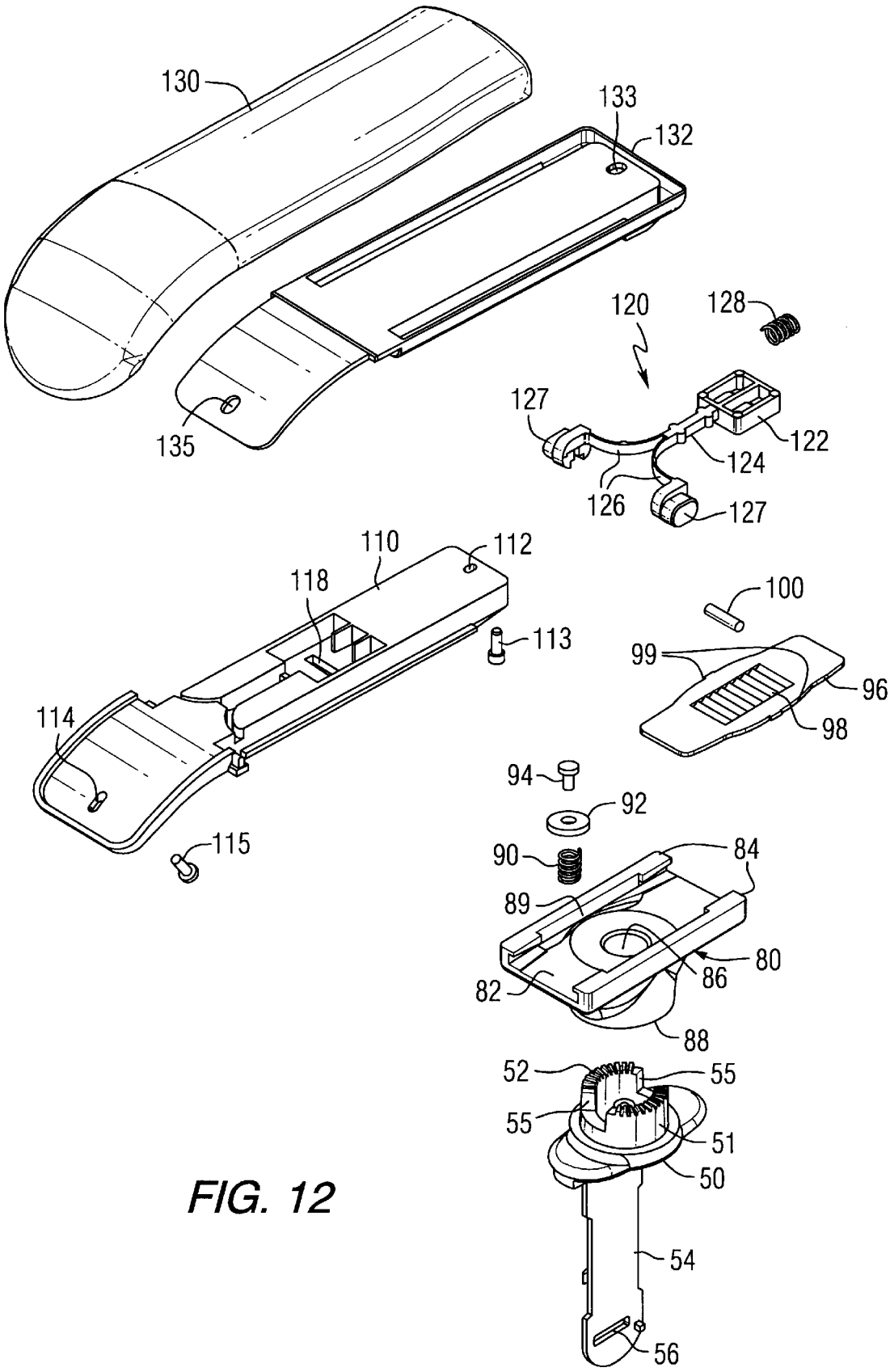
FIG. 12 is an exploded view of an upper portion of the embodiment shown in FIG. 1.

Referring now to FIG. 12, wherein an exploded view of an upper portion of the adjustable armrest assembly is illustrated, the armrest 12 can include an arm pad portion 130, a liner portion 132 and a bottom portion 110. The arm pad 130, liner 132, and bottom portion 110 are connected to each other via holes 133, 135, 112, and 114 via fasteners 113 and 115. The bottom portion 110 can be slidably connected to a collar 82 which can itself be rotatably connected to a top end 51 of the post 50.

Figure 13:
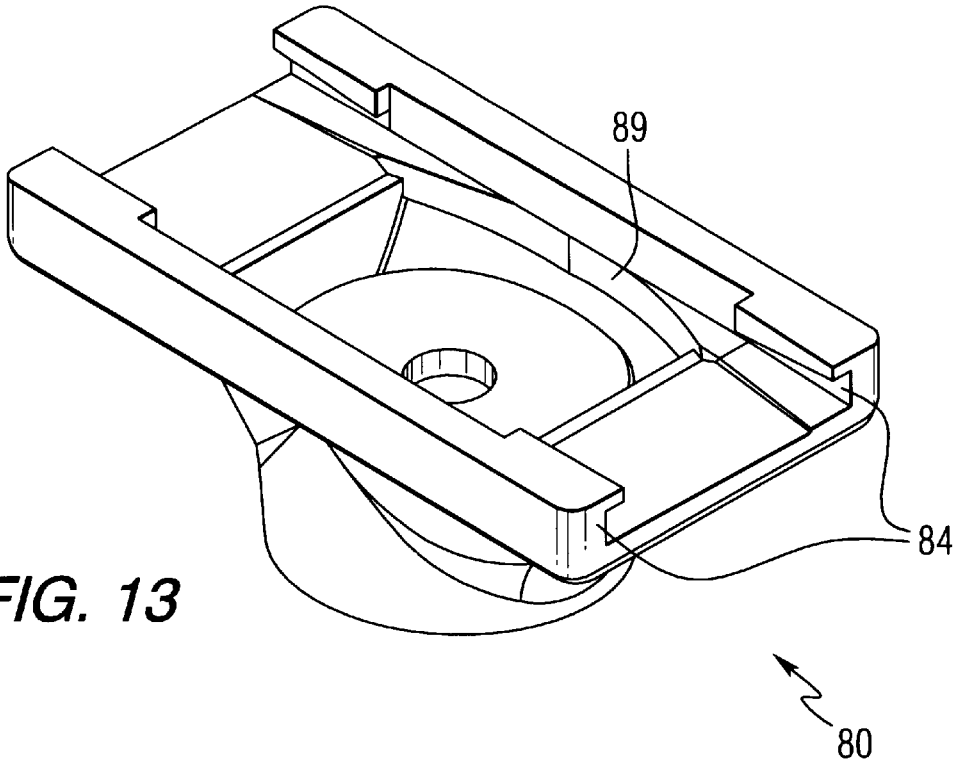
FIG. 13 is an enlarged perspective view of a collar shown in FIG. 12.
Figure 15:
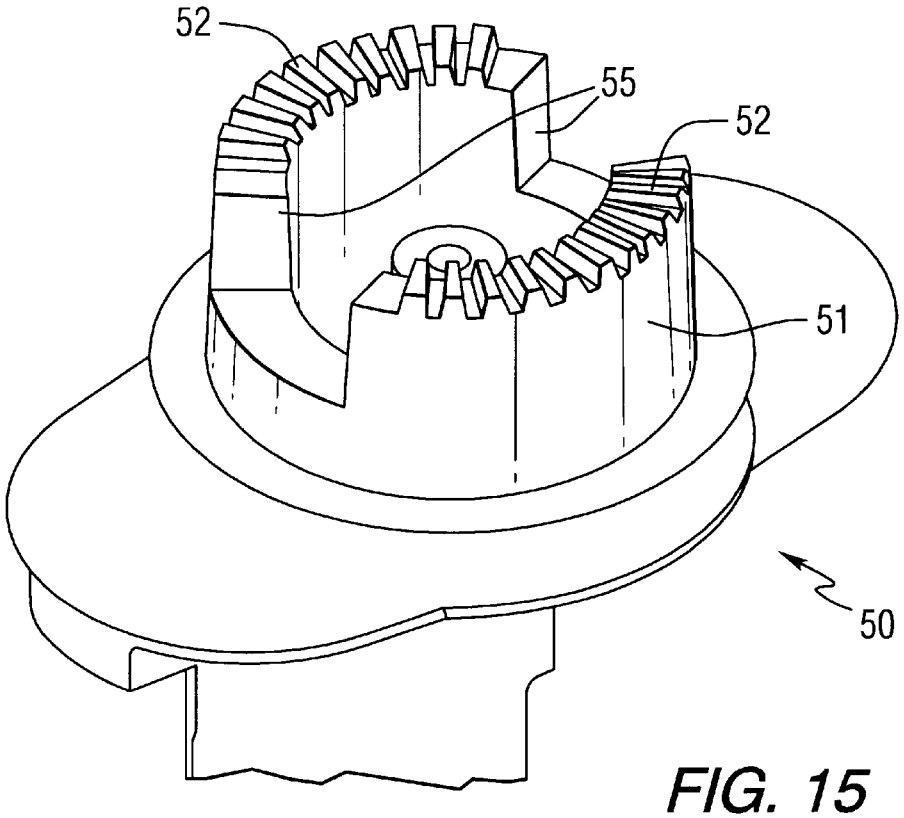
FIG. 15 is an enlarged view of the top of an embodiment of a post shown in FIG. 12.
Figure 14:
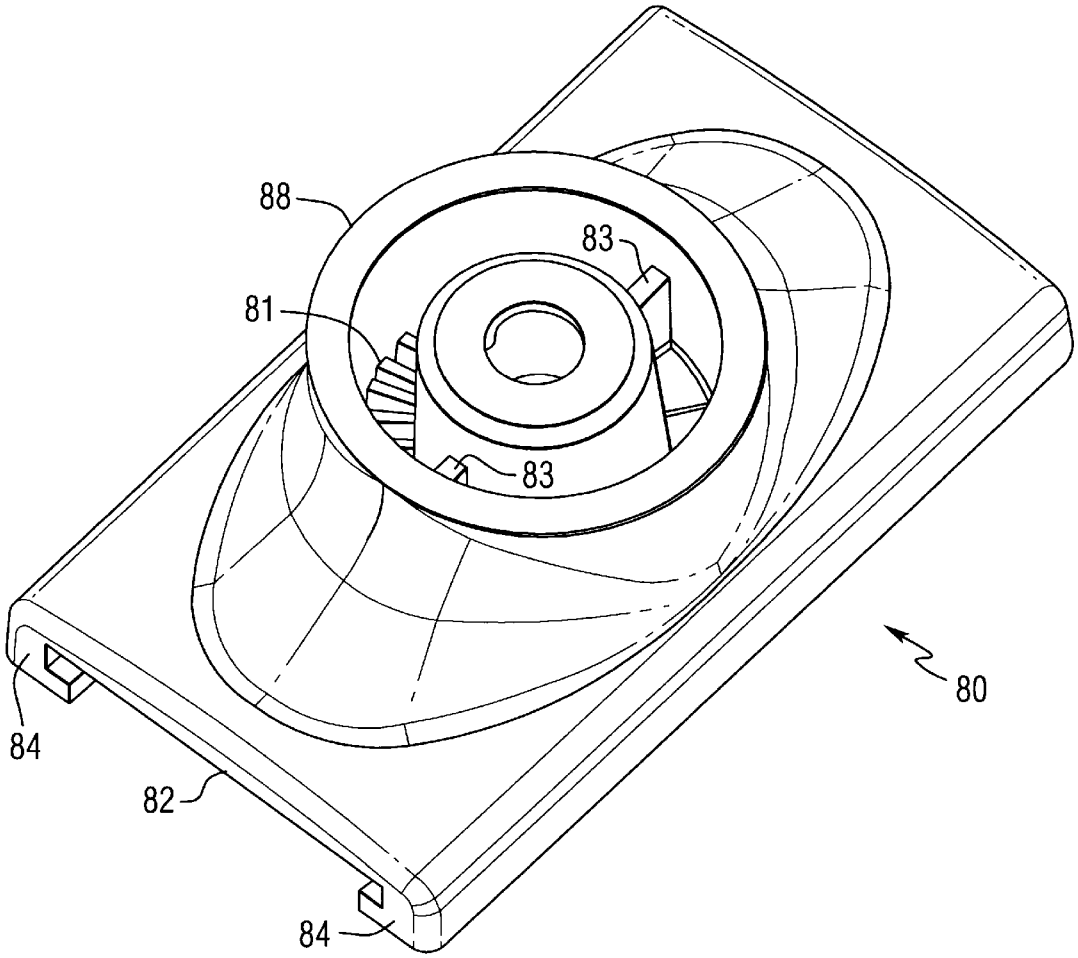
FIG. 14 is a perspective view of the underside of the collar shown in FIG. 13.

A third positive adjustment mechanism can be provided for slidably adjusting the bottom portion 110 along the collar 80 to position the armrest 12 from front to back, as shown in FIG. 20. Similar to the second positive adjustment mechanism, the third positive adjustment mechanism utilizes a combination of a grooved surface, a cylindrical pin, and a pocketed locking member. The third positive adjustment mechanism can be formed from cooperating portions of a fixed plate 96, the collar 80, and the bottom portion 110 of the armrest 12. The fixed plate 96 can be provided with a plurality of grooves 98 in an upper surface thereof. The fixed plate 96 can be received in a recess 89 in the collar 80. As shown best in FIGS. 12 and 13, arcuate portions 99 of the fixed plate 96 are received by and firmly held in the curved mating portions of the recess 89. The bottom portion 110 can have a slot 118 therethrough which is adjacent to the plurality of grooves 98.

As shown in FIGS. 12–14, and 17, the bottom portion 110 can also have a pair of side rails 119 (opposite rail not shown) which can be slidably retained in a channel 82 between side portions 84 of the collar 80. Additionally, the bottom portion 110 can further include a Y-shaped channel 116 formed therein and a Y-shaped actuator 120 slidably disposed in the Y-shaped channel 116. The divergent legs 126 of the Y-shaped actuator 120 are positioned in correspondingly shaped diverging portions of the Y-shaped channel and can have buttons 127 provided at ends thereof which extend beyond the edges of the bottom portion 110 so as to be externally accessible to operate the Y-shaped actuator 120.

Figure 18:
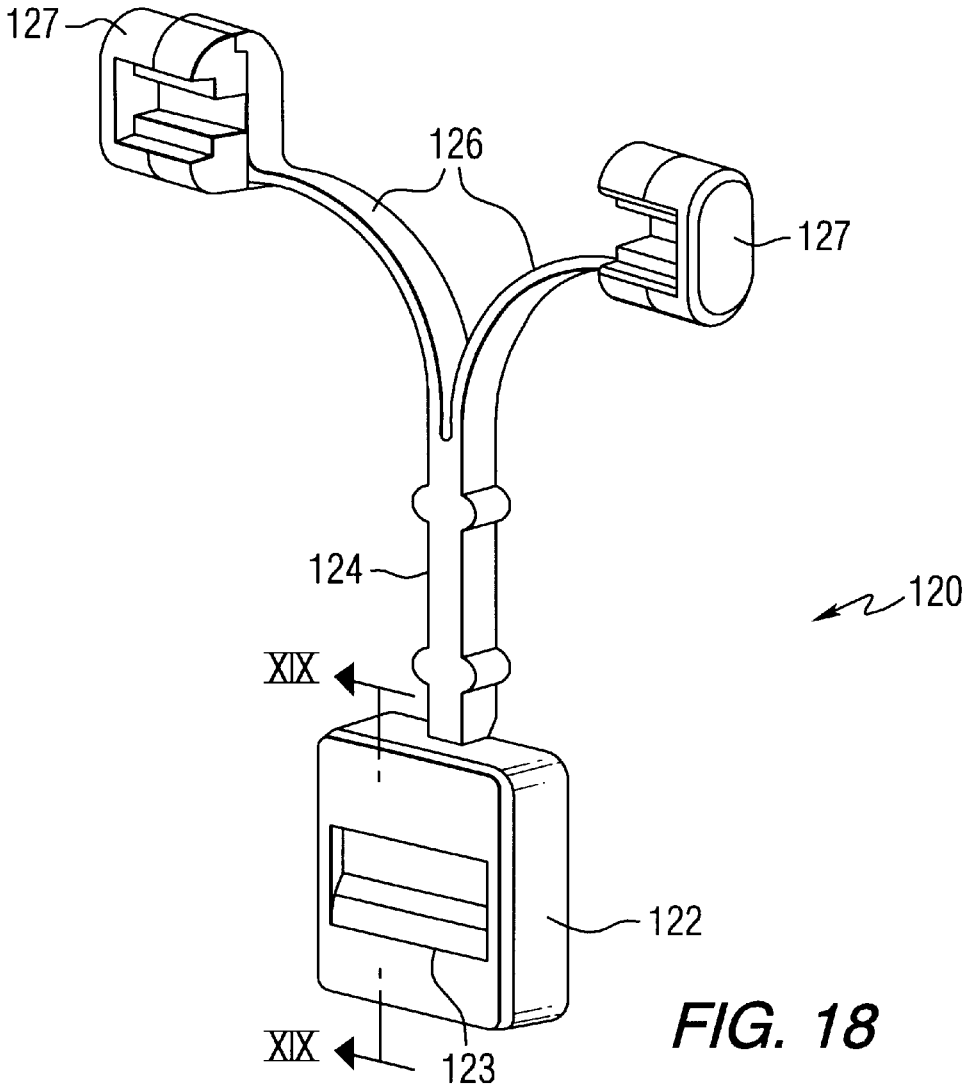
FIG. 18 is an enlarged perspective view of an embodiment of an actuator shown in FIG. 12.

The Y-shaped actuator 120 can also have a lock member 122 attached thereto, as shown in FIG. 18. The lock member 122 can be provided with a pocket 123 adjacent the plurality of grooves 98. A second cylindrical pin 100 can be disposed in the slot 118 in communication with the lock member 122 on one side and the plurality of grooves 98 on the other.

Figure 19:
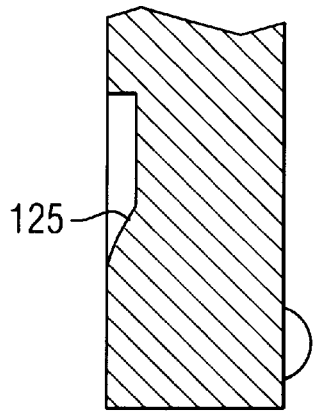
FIG. 19 is a partial cross section of FIG. 18 taken along the line XIX—XIX.

The lock member 122 is movable between a locked position and an unlocked position by the Y-shaped actuator 120. In the locked position, the lock member 122 retains the second cylindrical pin 100 in one of the plurality of grooves 98 so that the pair of rails 119 of the bottom portion 110 cannot slide within the side portions 84 of the channel 82 in the collar 80. In the unlocked position, the second cylindrical pin 100 is released from one of the plurality of grooves 98 into the pocket 123 so that the bottom portion 110 can freely slide in the channel 82 in the collar 80. As shown best in FIGS. 18 and 19, the pocket 123 can have a ramped profile 125 which rolls the second cylindrical pin 100 into one of the plurality of grooves 98 as the lock member 122 is moved to a locked position.

Figure 16:
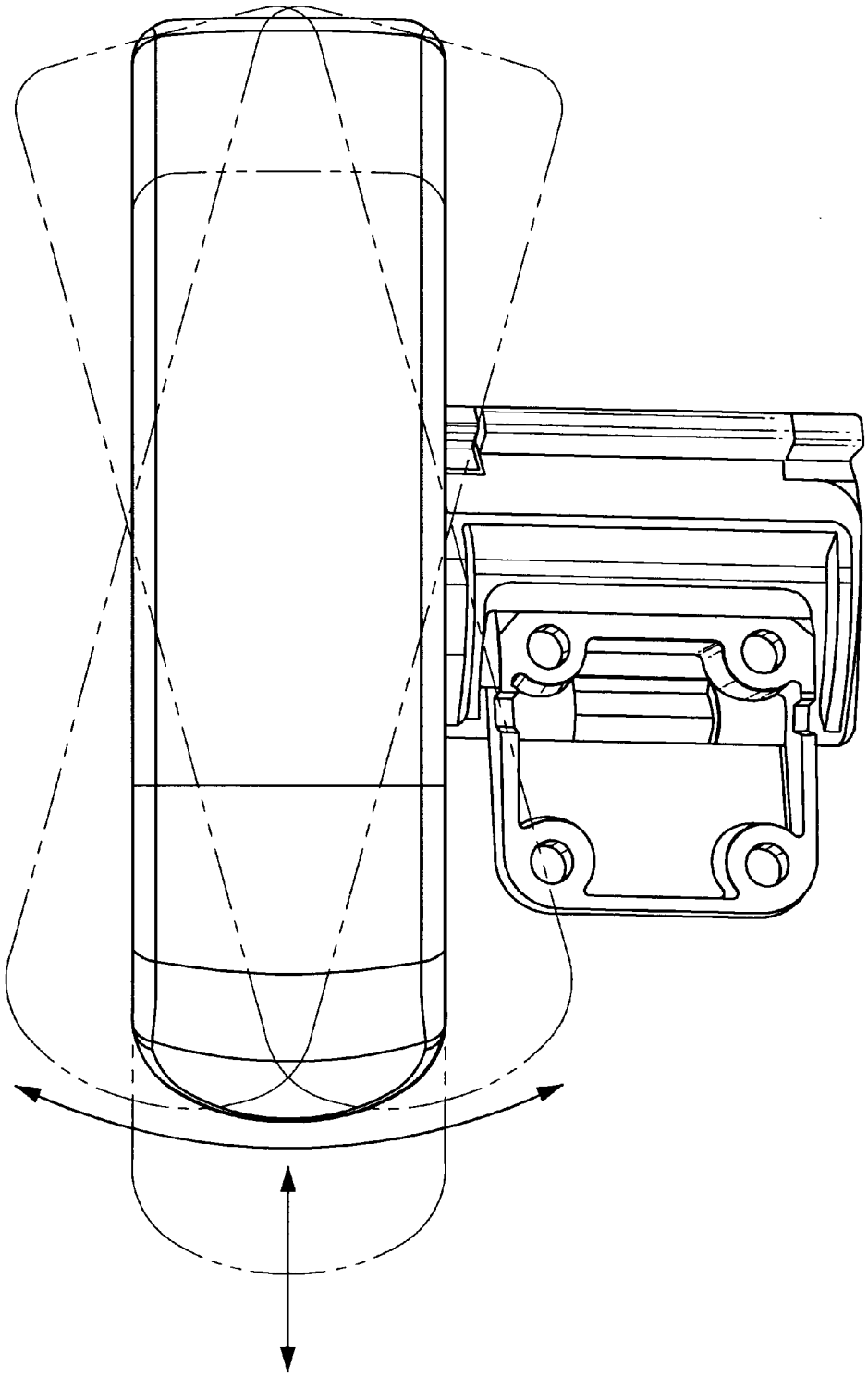
FIG. 16 illustrates how the armrest shown in FIG. 1 can rotate and move forwards and backwards.
Figure 17:
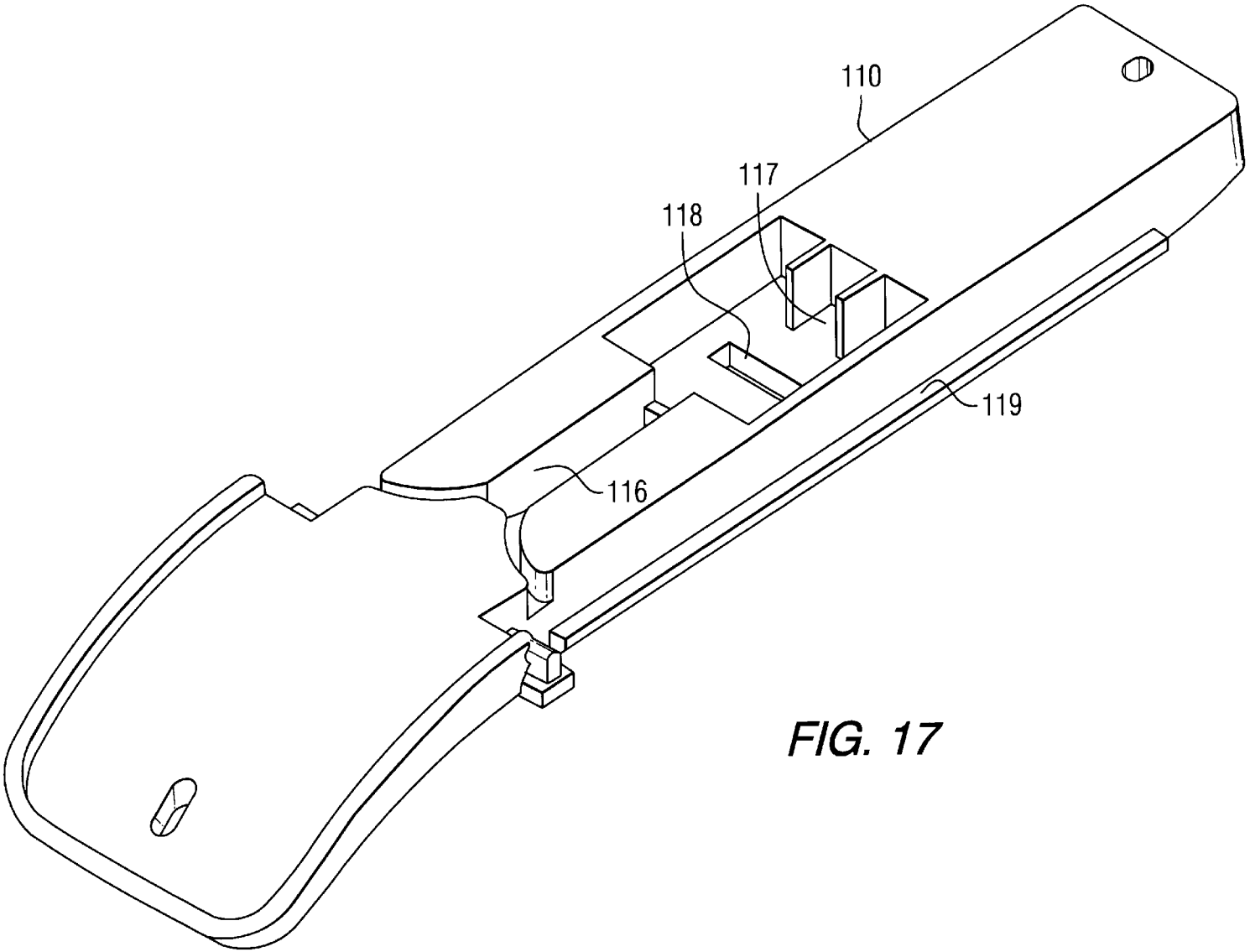
FIG. 17 is an enlarged perspective view of a bottom portion of the armrest shown in FIG. 13.

Additionally, a second spring 128 can be provided for biasing the lock member 122 in a locked position. The spring 128 is positioned in a channel 117 formed in the bottom portion 110 abutting the lock member 122. To actuate the lock member 122, the externally accessible buttons 127 are pressed towards each other causing the divergent legs 126 to move towards each other within the Y-shaped channel 116. As the divergent legs 126 are urged towards each other, the Y-shaped channel 116 translates that movement into a lateral movement in which the single leg 124 of the Y-shaped member 120 moves the lock member 122 against the second spring 128 and into an unlocked position. This releases the second cylindrical pin 100 into the pocket 123 and disengaging it from one of the plurality of grooves 98. The armrest 12 can then be moved forwards and backwards, as illustrated in FIG. 16, to locate the most comfortable position. When the divergent legs 126 are released, the second spring 128 biases the lock member 122 back to the locked position thereby locking the armrest 12 in the desired position.

Referring now to FIGS. 12–15, there can be provided a fourth positive adjustment mechanism for permitting the armrest 12 to be rotated about the shroud 44 so that the user may position the armrest 12 in towards, or away from, the user. The fourth positive adjustment mechanism can be formed from cooperating portions of the collar 80 and the post 50. The collar 80 can have a lower cylindrical portion 88 having a plurality of radially spaced notches 81 provided on a bottom surface thereof. The post 50 can have a top end 51 having a cylindrical edge in which can be provided a series of radially spaced teeth 52. The plurality of radially spaced teeth 52 are firmly held in the plurality of radially spaced notches 81.

To rotate the armrest 12, as shown in FIG. 16, the user can grasp the armrest 12, lift upwardly, and rotate to the desired position. As the armrest 12 is lifted up the teeth 52 are lifted out of engagement with the notches 81 so the armrest 12 can freely rotate. When the desired amount of rotation is completed, the armrest 12 is released downwards so the teeth 52 once again are held in place in the notches 81.

As shown in FIG. 12, a spring 90 can be provided to bias the collar 80 against the top end 51 of the post 50. A fastener 94 and a washer 92 cooperate with the spring 90 to hold the collar 80 against the top end 51 of the post 50. However, the force of the spring 90 against the collar 80 can be limited so that the user can lift up on the armrest 12 and overcome the spring force to disengage the teeth 52 from the notches 81 to permit the collar 80 to rotate on the top end 51 of the post 50 as described above. Additionally, a pair of ribs 83 on an inside surface of the lower cylindrical portion 88 can be provided to engage a pair of gaps 55 provided in the top end 51 in order to provide an overall limit to the degree of rotational movement. As the armrest 12 is rotated, the ribs 83 will eventually engage one of the gaps 55 and prevent further rotation beyond that point.

The multi-adjustable armrest assembly having features of the present invention thus permits for the armrest to be adjusted laterally in towards, or away from, the base of the chair, vertically up and down, forwards and backwards and also rotated in towards, or away from, the user. Moreover, in each instance the movement is precisely controlled by a positive adjustment mechanism.

While certain embodiments of the invention have been described in detail, it will be appreciated by those skilled in the art that various modifications to those details could be developed in light of the overall teachings of the disclosure. Accordingly, the particular embodiments disclosed herein are intended to be illustrative only and not limiting to the scope of the invention which should be awarded the full breadth of the following claims and any and all embodiments thereof.

What is claimed is:

1. A multi-adjustable armrest assembly for a chair comprising:

an armrest base securable to a chair;

an armrest support having a horizontal leg and a vertical leg, said horizontal leg slidably connected to the base;

a first positive adjustment mechanism cooperating with the horizontal leg and the armrest base for lateral adjustment of the armrest support relative to the distance between the armrest support and the chair;

a shroud slidably disposed on the vertical leg;

a second positive adjustment mechanism cooperating with the shroud and the vertical leg for vertical adjustment of the shroud;

an armrest connected to the shroud;

a third positive adjustment mechanism cooperating with said armrest and said shroud for lateral adjustment of said armrest relative to said shroud in a direction parallel to the chair such that the distance between the armrest and the chair is not altered by such adjustment; and each of said first, second and third positive adjustment mechanisms releasably lockable in a desired position.

2. The multi-adjustable armrest assembly of claim 1 wherein said third positive adjustment mechanism further comprises:

a post connected to the shroud;

a collar connected to said post;

armrest having a bottom portion slidably connected to said collar; and said third positive adjustment mechanism cooperating with the bottom portion of the armrest and the collar for said lateral adjustment of the armrest relative to the collar in said direction parallel to the chair.

* * * * *

UNITED STATES PATENT AND TRADEMARK OFFICE

CERTIFICATE OF CORRECTION

PATENT NO. : 6,053,578

DATED : April 25, 2000

INVENTOR(S) : HENDRIK VAN HEKKEN, CIRA V. CONLEY, MICHAEL S. GARNER

It is certified that error appears in the above-indentified patent and that said Letters Patent is hereby corrected as shown below:

Column 8, line 11, claim 2, before "armrest", insert —said—.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*